US006395441B1

(12) United States Patent
Uesugi et al.

(10) Patent No.: US 6,395,441 B1
(45) Date of Patent: May 28, 2002

(54) ELECTROPHOTOGRAPHIC PHOTOSENSITIVE MEMBER, PROCESS CARTRIDGE AND ELECTROPHOTOGRAPHIC APPARATUS

(75) Inventors: Hirotoshi Uesugi, Shizuoka; Hideki Anayama, Kanagawa, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/747,959

(22) Filed: Dec. 27, 2000

(30) Foreign Application Priority Data

Dec. 28, 1999 (JP) ..... 11-373849

(51) Int. Cl.[7] ..... G03G 5/147

(52) U.S. Cl. ..... 430/66; 430/58.2; 430/59.6; 430/67; 430/96; 399/116; 399/159

(58) Field of Search ..... 430/66, 67, 56, 430/58.2, 96, 59.6; 399/116, 159

(56) References Cited

U.S. PATENT DOCUMENTS 5,610,690 A 3/1997 Yoshihara et al. ..... 399/167
5,905,008 A * 5/1999 Yoshinaga ..... 430/58.2
6,203,954 B1 * 3/2001 Anayama ..... 430/67

FOREIGN PATENT DOCUMENTS

JP 5-034940 * 2/1993 ..... 430/66
JP 2000-81715 3/2000

OTHER PUBLICATIONS

Japanese Patent Office Machine–Assisted Translation of JP 5–34940, Feb. 1993.*

* cited by examiner

*Primary Examiner*—Janis L. Dote
(74) *Attorney, Agent, or Firm*—Fitzpatrick, Cella, Harper & Scinto

(57) ABSTRACT

The present invention provides an electrophotographic photosensitive member having a surface layer containing diorganopolysiloxane having, as substituents, a perfluoro group, and a group having a substituted or unsubstituted polystyrene chain, a closed terminal and a degree of polymerization of 3 or more. The present invention also provides a process cartridge having the electrophotographic photosensitive member, and an electrophotographic apparatus.

10 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each comprising the electrophotographic photosensitive member. Particularly, the present invention relates to an electrophotographic photosensitive member comprising a surface layer containing a specified silicone resin, and a process cartridge and an electrophotographic apparatus each comprising the electrophotographic photosensitive member.

2. Description of the Related Art

An electrophotographic photosensitive member is required to have sensitivity, electrical properties, and optical properties corresponding to the electrophotographic process used. Particularly, an electrophotographic photosensitive member repeatedly used is further required to have durability against electrical and mechanical external forces applied directly in charging, image exposure, toner development, transfer, and cleaning. More specifically, the electrophotographic photosensitive member is required to be durability against chemical deterioration due to ozone and nitrogen compounds produced in charging, and mechanical and electric deterioration due to discharge in charging and sliding friction of a cleaning member.

Unlike an inorganic photosensitive member, an electrophotographic photosensitive member a relatively soft material containing an organic photoconductive material has insufficient durability against mechanical deterioration. Therefore, various attempts have been made for satisfying this durability requirement.

Particularly, an example of a method of effectively preventing mechanical deterioration to increase durability is a method comprising adding fluororesin particles to the surface layer of the electrophotographic photosensitive member to decrease the friction coefficient of the surface of the electrophotographic photosensitive member. In this method, sliding friction with a cleaning member is smoothed to prevent a strong shear stress from being applied to the surface of the electrophotographic photosensitive member.

However, the fluororesin particles generally have low surface tension, and cannot be easily uniformly dispersed in a resin having relatively high surface tension. Therefore, the use of various dispersion auxiliary materials has been proposed. However, many commercial dispersion auxiliary materials have a complicated structure because of the excellent dispersibility of the fluororesin, and thus secondary agglomerates of the fluororesin cannot be easily stabilized during dispersion. This is a great problem for the surface layer of a very thin electrophotographic photosensitive member having a thickness of about 1 to 100 $\mu$m, and is one of the causes for producing blurring or fogging in an image.

In addition, the dispersion auxiliary material traps carriers to cause a variation in potential in some cases.

SUMMARY OF THE INVENTION

Accordingly, an object of the present invention is to resolve the problem inherent in a conventional surface layer comprising a binder resin containing fluororesin particles dispersed therein, and provide an electrophotographic photosensitive member comprising a surface layer that contains fluororesin particles uniformly dispersed therein to improve durability after the formation of the electrophotographic photosensitive member, and that exhibits excellent surface lubricity without negatively affecting its electrophotographic properties.

Another object of the present invention is to provide a process cartridge and an electrophotographic apparatus each comprising the electrophotographic photosensitive member.

In order to achieve these objects, the present invention provides an electrophotographic photosensitive member comprising a photosensitive layer formed on a support member, wherein the surface layer of the electrophotographic photosensitive member contains diorganopolysiloxane represented by the following formula (1):

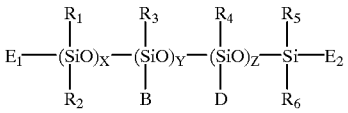

(1)

(wherein $R_1$ to $R_6$ each represent a substituted or unsubstituted hydrocarbon group, B represents a substituted or unsubstituted organic group having a perfluaroalkyl group, at least one D represents a substituted or unsubstituted polystyrene chain having a closed terminal and a degree of polymerization of 3 or more, $E_1$ and $E_2$ each represent a group selected from $R_1$ to $R_6$, B and D, X represents an integer of 0 to 1000, and Y and Z each represent an integer of 1 to 1000).

Further objects, features and advantages of the present invention will become apparent from the following description of the preferred embodiments (with reference to the attached drawings).

DESCRIPTION OF THE PREFERRED EMBODIMENTS

Figure 1:
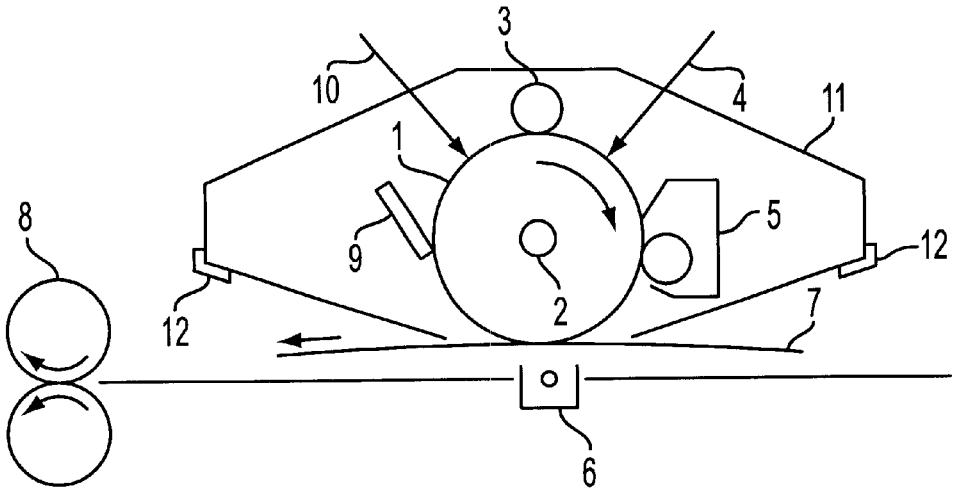
FIG. 1 is a schematic view of an electrophotographic apparatus comprising a process cartridge comprising an electrophotographic photosensitive member of the present invention.

Preferred examples of substituted or unsubstituted hydrocarbon groups of $R_1$ to $R_6$ in the formula (1) include alkyl groups having a carbon number of 1 to 30, alkenyl groups, aryl groups, arylakyl groups, and the like. Particularly, a methyl group, and a phenyl group are preferred. $R_1$ and $R_6$ may be the same or different.

Although B represents a substituted or unsubstituted organic group having a perfluoroalkyl group, the group is preferably represented by the following formula (2):

$$—R_7(CF_2)_2—F \quad (2)$$

(wherein $R_7$ represents an alkylene group or an alkyleneoxyalkylene group, and a represents an integer of 3 or more).

Examples of alkylene groups of $R_7$ include an ethylene group, a propylene group, and the like, and examples of alkyleneoxyalkylene groups include an ethyleneoxyethylene group, an ethyleneoxypropylene group, a propyleneoxypropylene group, and the like.

A group D having the polystryene chain is preferably represented by the following formula (3):

$$-W_1-(SiR_8R_9)_b-W_2 \quad (3)$$

(wherein $R_8$ and $R_9$ each represent a substituted or unsubstituted alkyl group, or a substituted or unsubstituted aryl group, $W_1$ represents a hydrocarbon group, $W_2$ represents a substituted or unsubstituted polystyrene chain having a closed terminal and a degree of polymerization of 3 or more, and b represents 0 or 1).

Examples of alkyl groups of $R_8$ and $R_9$ include a methyl group, an ethyl group, a propyl group, and the like, and examples of aryl groups include a phenyl group, and the like. $R_8$ and $R_9$ may be the same or different. Examples of hydrocarbon groups of $W_1$ include a methylene group, an ethylene group, a propylene group, and the like, which preferably have 1 to 10 carbon atoms.

$E_1$ and $E_2$ each represent a group selected from $R_1$ to $R_6$, B and D, and may be the same or different.

Examples of substituents which may be possessed by the above groups include halogen atoms such as a fluorine atom, a chlorine atom, an iodine atom, and the like; alkyl groups such as a methyl group, an ethyl group, a propyl group, and the like; aryl groups such as a phenyl group, and the like.

Although X represents an integer of 0 to 1000, X is preferably an integer of 10 to 200.

Although Y represents an integer of 1 to 1000, Y is preferably an integer of 10 to 200.

Although Z represents an integer of 1 to 1000, Z is preferably an integer of 5 to 100.

The total (X+Y+Z) is preferably 2 to 2000, more preferably 5 to 1000, and most preferably 20 to 500. The total (Y+Z) is preferably 10 to 30.

In the present invention, when each of X, Y and Z is 2 or more, each of $R_1$ to $R_4$, B and D may include at least two types of groups. For example, when Z is 3, three groups D may be the same, two groups D may be the same, or three groups D may be different. An example in which Z is 20 is represented by formula (1-9) below.

In the formula (1), for the sake of convenience, the number of siloxane units having $R_1$ and $R_2$ is denoted by X, the number of siloxane units having $R_3$ and B is denoted by Y, and the number of siloxane units having $R_4$ and D is denoted by Z, as shown in the examples below. However, these units may be mixed with each other. Namely, the siloxane units having $R_1$ and $R_2$ and the siloxane units having $R_3$ and B may be alternately present. For example, the siloxane units may be combined as shown by the following formula:

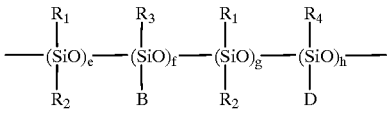

(wherein e, f, g, and h each represent an integer).

Preferred examples of diorganopolysiloxane represented by the formula (1) are given below.

Particularly, formulae (1-1), (1-2), (1-8), (1-9), (1-11) and (1-12) are preferred, and of these formulae (1-1), (1-8), (1-11) and (1-12) are more preferred.

(1-1)

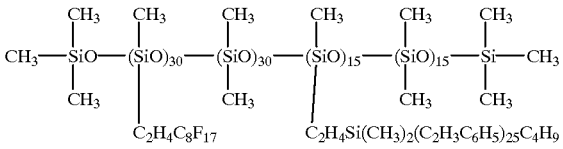

(1-2)

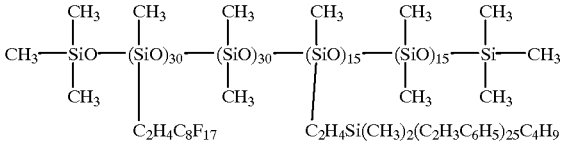

(1-3)

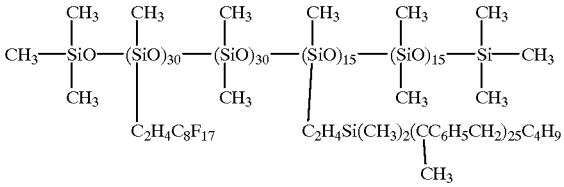

(1-4)

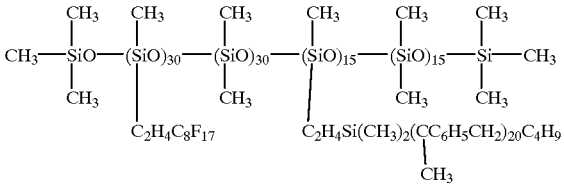

(1-5)

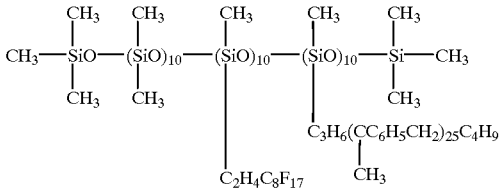

(1-6)

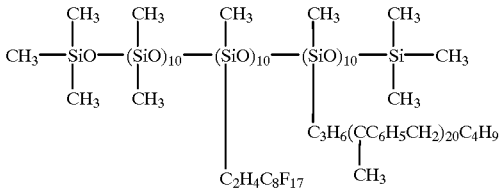

(1-7)

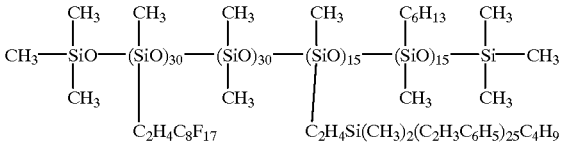

-continued (1-8)

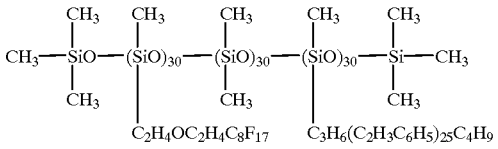

(1-9)

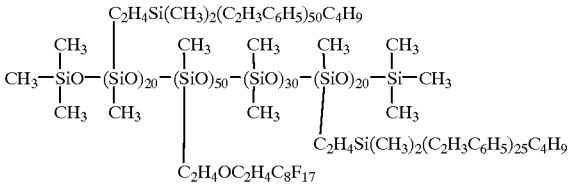

(1-10)

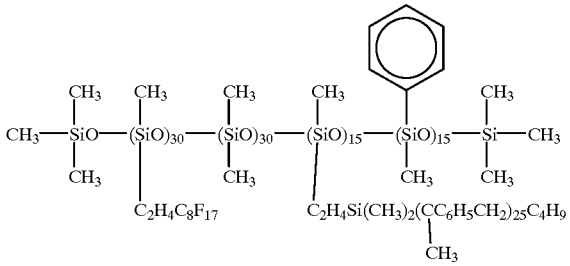

(1-11)

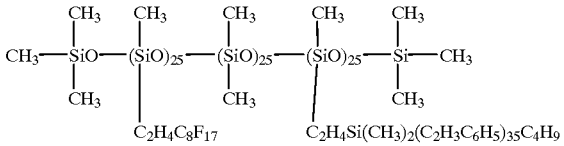

(1-12)

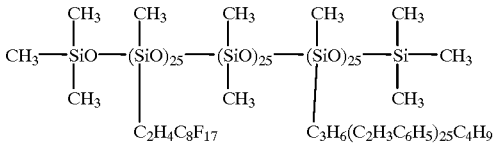

The weight average molecular weight of the diorganopolysiloxane used in the present invention is preferably 1.000 to 1,000,000, more preferably 10,000 to 200,000.

The content of fluorine atoms in the diorganopolysiloxane is preferably 1 to 70% by weight, and more preferably 5 to 60% by weight, based on the total weight of the diorganopolysiloxane. With a fluorine atom content of less than 1% by weight, the dispersion stabilizing function of the fluorine resin particles is not sufficiently exhibited, while with a fluorine atom content of over 70% by weight, compatibility with a binder resin readily deteriorates.

Although the reason why the significant effect of the present invention can be obtained is not apparent, the effect is possibly due to the fact that the organic group B having a perfluoroalkyl group exhibits affinity for the fluororesin particles, the polystyrene chain D exhibits affinity for the binder resin, and the polyorganosiloxane chain has high flexibility, and thus the polyorganosiloxane is interposed between the fluororesin particles and the binder resin to promote the dispersion of the fluororesin particles in the organic resin, and cause the function to prevent agglomeration of the fluororesin particles. When D includes at least two types of groups, D other than the polystyrene chain may be a substituted or unsubstituted organic group having a polyoxyalkylene group disclosed in Japanese Patent Laid-Open No. 2000-81715, or a substituted or unsubstituted organic group having a siloxane chain and a substituted or unsubstituted alkyl group having 12 or more of carbon atoms.

The construction of the electrophotographic photosensitive member of the present invention will be described. The electrophotographic photosensitive member of the present invention comprises a photosensitive layer formed on a support member. The photosensitive layer may be a single layer type containing a charge transport material and a charge generation material in the same layer, or a laminated type comprising a charge transport layer containing the charge transport material and a charge generation layer containing the charge generation material. However, the laminated type is preferred from the viewpoint of electrophotographic properties.

The support member may comprise a material having conductivity, for example, such as a metal such as aluminum, stainless steel, or the like, and a metal, paper or a plastic provided with a conductive layer, or the like. As the shape of the support member, a sheet, a cylindrical shape, and the like may be used.

In the present invention, a conductive layer may be provided between the support member and the photosensitive layer, for preventing interference fringes or covering flaws of the support member. The conductive layer can be formed by dispersing conductive particles such as carbon black or metal particles in a binder resin. The thickness of the conductive layer is preferably 5 to 40 $\mu$m, and more preferably 10 to 30 $\mu$m. The interference fringes can also be prevented by cutting the cylinder or by alumite treatment.

Also, an intermediate layer having an adhesive function and a barrier function may be provided on the support member or the conductive layer. Examples of the material of the intermediate layer Include polyamide, polyvinyl alcohol, polyethylene oxide, ethyl cellulose, casein, polyurethane, polyetherurethane, and the like. Any one of these materials is dissolved in a suitable solvent and coated and the support member or the conductive layer. The thickness of the intermediate layer is preferably 0.05 to 5 $\mu$m, and more preferably 0.3 to 1 $\mu$m. With the cylinder treated directly with alumite, or provided with a conductive film by a sol-gel method, the intermediate layer need not be used.

The charge generation layer is formed on the support member, the conductive layer, or the intermediate layer. Examples of the charge generation material used in the present invention include selenium-tellurium, pyrylium, and thiapyrylium dyes, phthalocyanine, anthoanthrone, dibenzpyrenequinone, trisazo, cyanine, disazo, monoazo, indigo, quinacridone, and asymmetric quinocyanine pigments.

In a separated-function type, the charge generation layer is formed by coating a disperse solutions which is formed by sufficiently dispersing the charge generation material ad a 0.3 to 4-fold amount of binder resin in a solvent by a method using a homogenizer, ultrasonic dispersion, a ball mill, a vibration ball mill, a sand mill, an attritor, a roll mill, or a liquid-collision type high-speed dispersion machine, and then drying the coating. However, the binder resin can be added after the charge generation material is dispersed, or the binder resin need not be used according to the properties of the charge generation material used. The thickness of the charge generation layer is preferably 5 $\mu$m or less, and more preferably 0.1 to 2 $\mu$m.

The charge transport layer can be mainly formed by in a solvent, the charge transport material, the binder resin, and further diorganopolysiloxane represented by the formula (1) when the charge transport layer is the surface layer, and then dispersing the fluororesin particles in the resultant solution, followed by drying. Examples of the charge transport material include triarylamine compounds, hydrazine compounds, stilbene compounds, pyrazoline compounds, oxazole compounds, triarylmethane compounds, and thiazole compounds.

Examples of the binder resin used for the charge transport layer include thermoplastic binder resins, and hardening binder resins. Examples of such resins include phenoxy resins, polyacrylamide resins, polyvinylbutyral resins, polyacrylate resins, polysulfone resins, polyamide resins, acryl resins, acrylonitrile resins, methacryl resins, vinyl chloride resins, vinyl acetate resins, phenol resins, epoxy resins, polyester resins, alkyd resins, polycarbonate resins, polyurethane resins, and copolymers having at least two repeating units of these resins, such as styrene-butadiene copolymer, styrene-acrylonitrile copolymer, styrene-maleic acid copolymer, and the like. The binder resin can also be selected from organic photoconductive polymers such as poly-N-vinylcarbazole, polyvinylanthracene, and polyvinylpyrene, and the like.

Of these resins, polycrylate resins and polycarbonate resins are preferred because they have good affinity for diorganopolysiloxane represented by the formula (1) and the fluororesin to form a satisfactory coating solution. The polyacrylate resins and polycarbonate resins have the constitutional units represented by the following formulae (4) and (5), respectively.

(4)

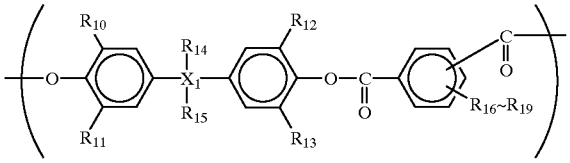

(wherein $X_1$ represents a carbon atom or a single bond (in which $R_{14}$ and $R_{15}$ are absent), $R_{10}$ to $R_{13}$ each represent a hydrogen atom, a halogen atom, a substituted or unsubstituted alkyl group, or a substituted or unsubstituted aryl group, $R_{14}$ and $R_{15}$ each represent a hydrogen atom, a halogen atom, a substituted or unsubstituted alkyl group, a substituted or unsubstituted aryl group, or a group necessary for forming a substituted or unsubstituted alkylidene group by combining $R_{14}$ and $R_{15}$, and $R_{16}$ to $R_{19}$ each represent a hydrogen atom, a halogen atom, a substituted or unsubstituted alkyl group, or a substituted or unsubstituted aryl group).

(5)

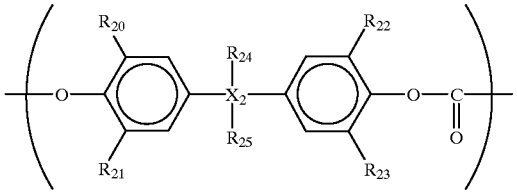

(wherein $X_2$ represents a carbon atom or a single bond (in which $R_{24}$ and $R_{25}$ are absent). $R_{20}$ to $R_{23}$ each represent a hydrogen atom, a halogen atom, a substituted or unsubstituted alkyl group, or a substituted or unsubstituted aryl group, $R_{24}$ and $R_{25}$ each represent a hydrogen atom, a halogen atom, a substituted or unsubstituted allyl group, a substituted or unsubstituted aryl group, or a group necessary for forming a substituted or unsubstituted alkylidene group by combination of $R_{24}$ and $R_{25}$).

In the formulae (4) and (5), examples of the halogen atom include a fluorine atom, a chlorine atom, a iodine atom, and the like, examples of the alkyl group include a methyl group, an ethyl group, a propyl group, and the like, examples of the aryl group include a phenyl group, a naphthyl group, and the like, and examples of the alkylidene group include a cyclohexylidene group, and the like.

Examples of substituents which may be possessed by these groups include halogen atoms such as a fluorine atom, a chlorine atom, an iodine atom, and the like; alkyl groups such as a methyl group, an ethyl group, a propyl group, and the like; and aryl groups such as a phenyl group, and the like.

Although preferred examples of the constitutional units of polyarylate resins are given below, the units are not limited to these examples.

Particularly, formulae (4-1), (4-2), (4-6), (4-9), (4-11), (4-13), (4-15), (4-22) and (4-23) are preferred, and of these formulae (4-2), (4-13), (4-15) and (4-23) are more preferred.

Moreover, the polymer which consists of a single constitutional unit or the copolymer which consists of two or more sorts of constitutional units is sufficient as these constitutional units.

(4-1)

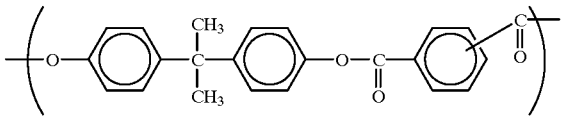

(4-2)

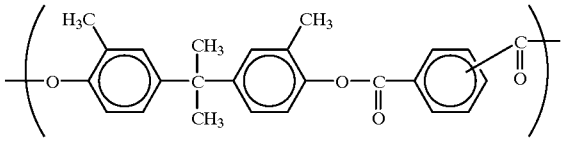

(4-3)

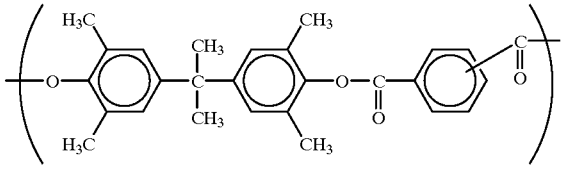

(4-4)

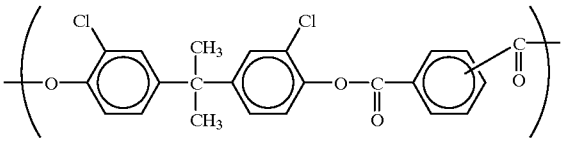

(4-5)

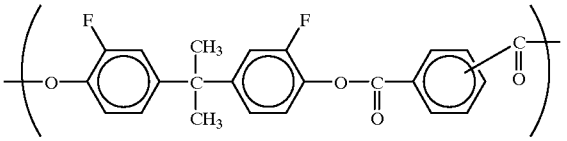

-continued
(4-6)
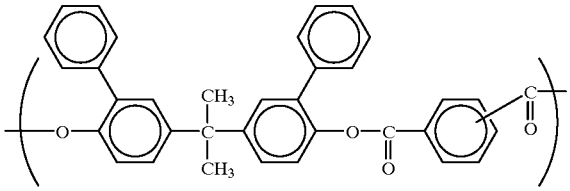
(4-7)
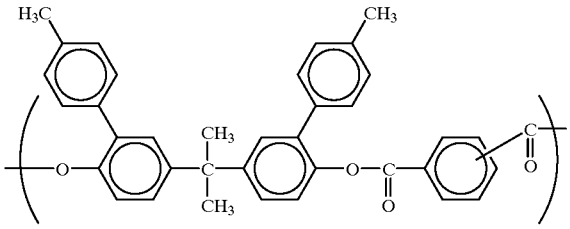
(4-8)
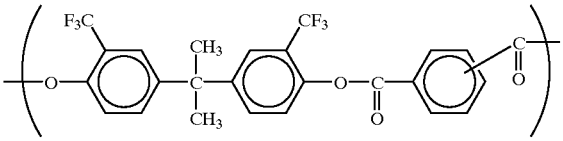
(4-9)
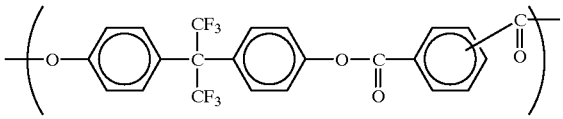
(4-10)
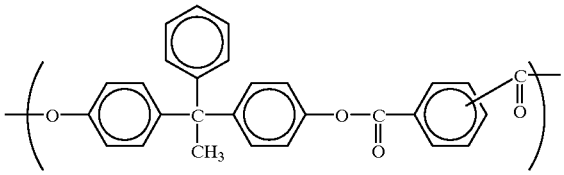
(4-11)
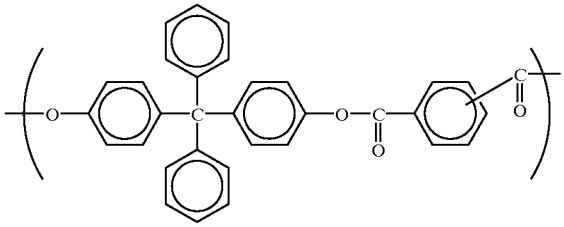
(4-12)
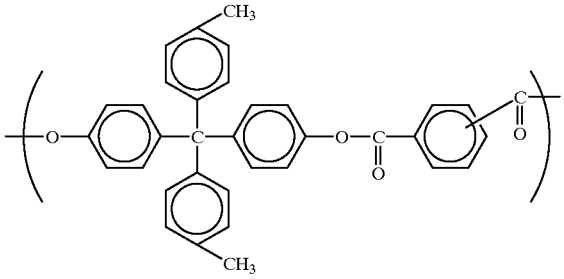
-continued
(4-13)
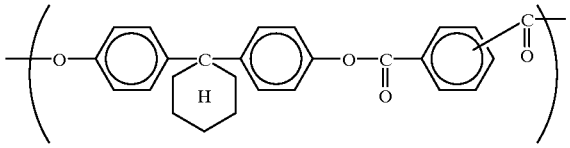
(4-14)
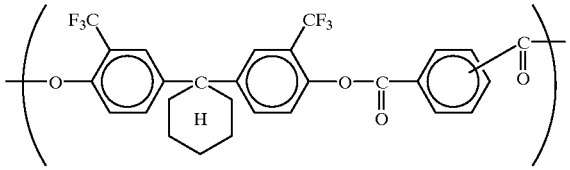
(4-15)
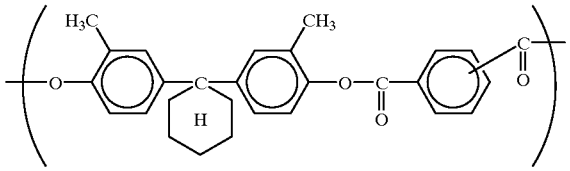
(4-16)
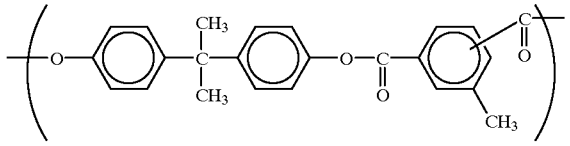
(4-17)
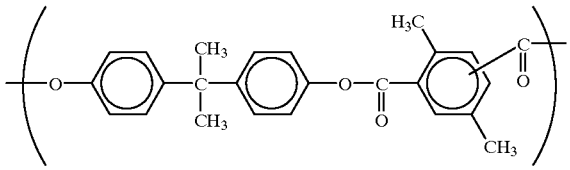
(4-18)
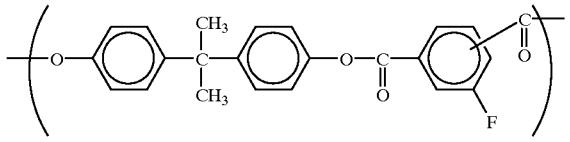
(4-19)
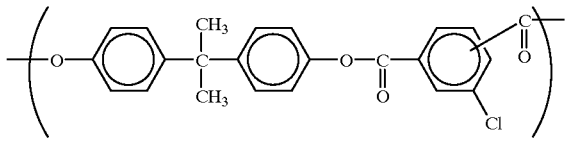
(4-20)
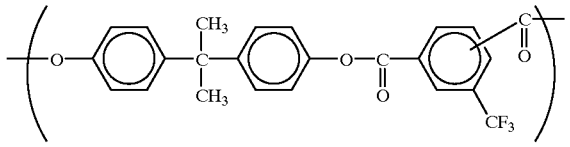

-continued (4-21)

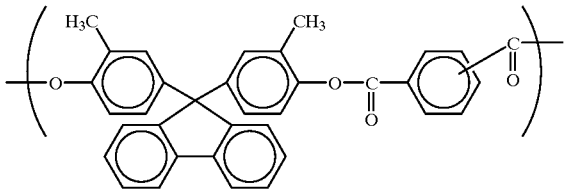

(4-22)

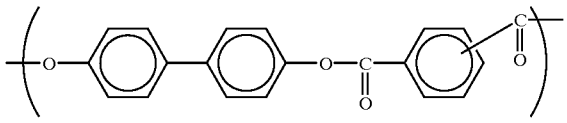

(4-23)

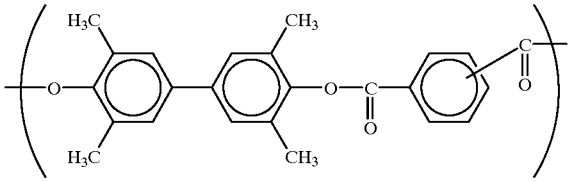

Although preferred examples of the constitutional units of polycarbonate resins are given below, the units are not limited to these examples.

Particularly, formulae (5-1), (5-3), (5-4), (5-7), (5-10), (5-12) (5-15), (5-16) and (5-17) are preferred, and of there formulae (5-1), (5-3), (5-4) and (5-17) are more preferred.

Moreover, the polymer which consists of a single constitutional unit or the copolymer which consists of two or more sorts of constitutional units is sufficient as these constitutional units.

(5-1)

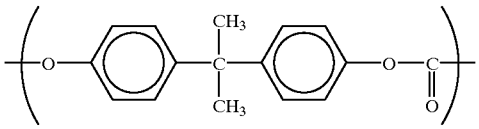

(5-2)

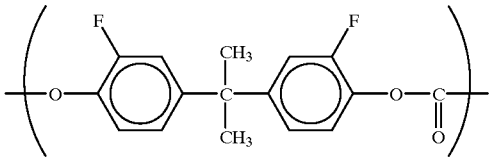

(5-3)

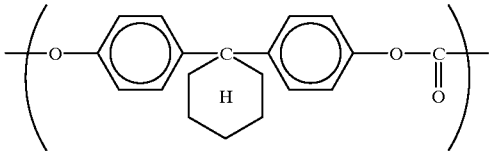

-continued (5-4)

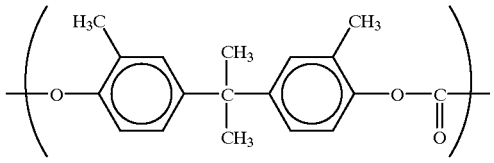

(5-5)

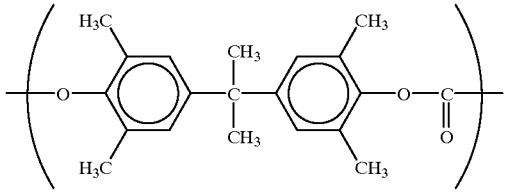

(5-6)

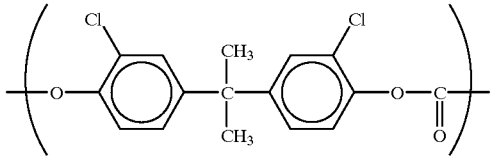

(5-7)

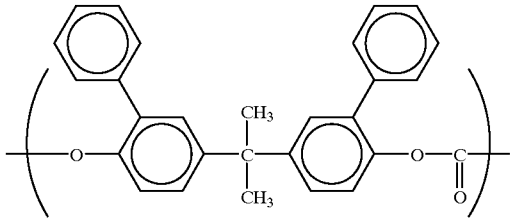

(5-8)

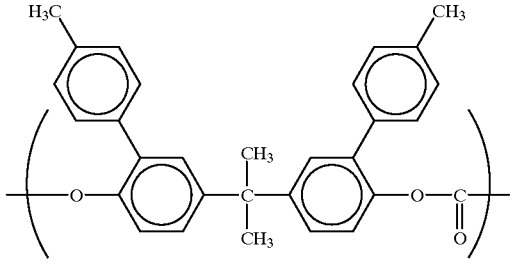

(5-9)

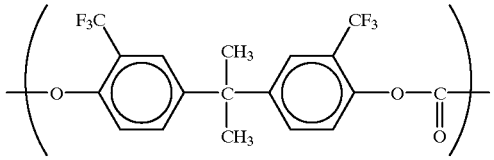

-continued (5-10)

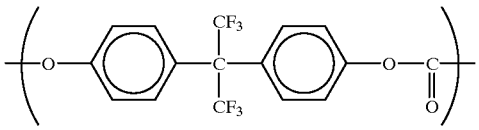

(5-11)

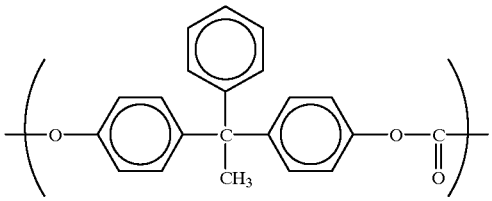

(5-12)

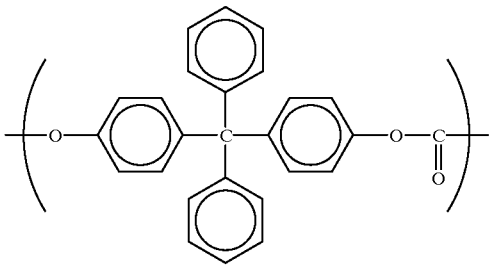

(5-13)

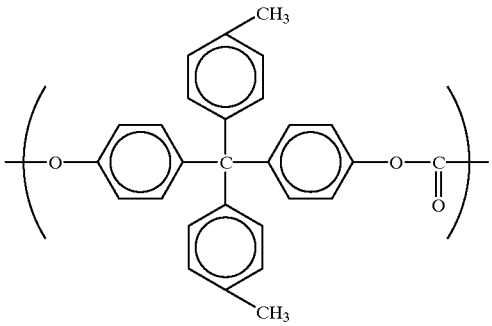

(5-14)

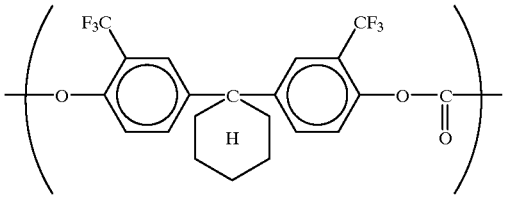

(5-15)

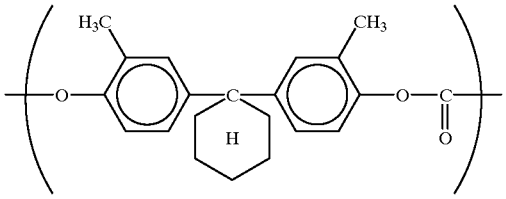

-continued (5-16)

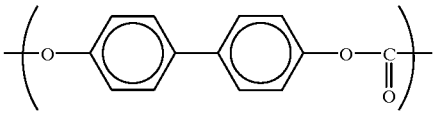

(5-17)

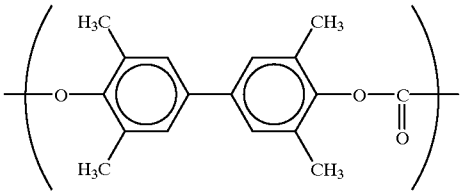

The thickness of the charge transport layer is preferably 5 to 50 $\mu$m, and more preferably 10 to 30 $\mu$m. The mass ratio of the charge transport material to the binder resin is 5:1 to 1:5, and preferably 3:1 to 1:3. As the coating method, dip coating, spray coating, spinner coating, blade coating, and roll coating can be used.

The diorganopolysiloxane represented by the formula (1) is preferably previously mixed with the fluororesin particles and the binder resin to form a dispersion. The content of the diorganopolysiloxane is preferably 0.1 to 30 parts by mass, and more preferably 3 to 25 parts by mass, based on 100 parts by mass of fluororesin particles. With an excessively low content, the effect of the present invention cannot be easily obtained, while with an excessively high content, carriers are trapped to easily cause a variation in potential.

The content of the fluororesin particles is preferably 0. 5 to 25 parts by mass based on 100 parts by mass of the binder resin. With a content of less than 0.5 parts by mass, only a small effect is obtained, while with a content of over 25 parts by mass, light transmittance significantly deteriorates to cause a significant adverse effect on the electrophotographic properties.

A dye, a pigment and an organic charge transport material are generally weak against ultraviolet rays, ozone, contamination with oil, and a metal, and thus a protecting layer may be provided according to demand. The protecting layer which can be used in the present invention is formed by coating a solution on the photosensitive layer, and then drying the coating. The solution contains a binder resin such as a polyester resin, a polycarbonate resin, an acryl resin, a methacryl resin, a polyamide resin, a polyimide resin, a polyacrylate resin, a polyurethane resin, a styrene-butadiene copolymer, a styrene-acrylic acid copolymer, or a styrene-acrylonitrile copolymer, or the like, and the fluororesin particles, and the organopolysiloxane represented by the formula (1). When a condensation monomer or a radical polymerization monomer having an unsaturated group is used for the binder resin, the coating may be cured by applying heat or energy light such as ultraviolet light to form the protecting layer. If required, conductive particles such as a metal or conductive metal oxide particles, or the charge transport material may be further contained in the protecting layer.

The thickness of the protecting layer is preferably 0.05 to 20 $\mu$m. Since the protecting layer can be made thinner than the charge transport layer, the amounts of the fluororesin particles, and the diorganopolysiloxane can be increased. Specifically, the amount of the diorganopolysiloxane used is preferably up to 100 parts by mass based on 100 parts by mass of fluororesin particles, and the amount of the fluororesin particles used is preferably up to 50 parts by mass based on 100 parts by mass of the binder resins.

Examples of the fluororesin particles include particles of a tetrafluoroethylene resin, a trifluorochloroethylene resin, a tetrafluoroethylene hexafluoroethylenepropylene resin, a vinyl fluoride resin, a vinylidene fluoride resin, a difluorodichloroethylene resin, a copolymer resin of these resins, and the like. Of these resins, particularly, a tetrafluoroethylene resin is preferred from viewpoint of the electrophotographic properties.

In order to disperse the fluororesin particles, an emulsifier or dispersion machine such as a homogenizer, a line mixer, an ultra disperser, a homomixer, a light-collision type high-speed dispersion machine, an ultrasonic dispersion machine, or the like, or a mixing apparatus such as a mixer or the like can be used.

FIG. 1 shows the schematic construction of an electrophotographic apparatus having a process cartridge comprising the electrophotographic photosensitive member of the present invention. In FIG. 1, reference numeral 1 denotes the electrophotographic photosensitive member of the present invention, which is rotated around a shaft 2 at a predetermined peripheral speed in the arrow direction shown in FIG. 1. In a rotation process, the peripheral surface of the photosensitive member 1 is uniformly changed with a positive or negative predetermined potential by primary charging means 3, and then receives exposure light 4 from exposure means (not shown) for slit exposure, laser beam scanning exposure, or the like. As a result, an electrostatic latent image is successively formed on the peripheral surface of the photosensitive member 1.

The thus-formed electrostatic latent image is developed with toner by development means 5, and the developed toner image is successively transferred, by transfer means 6, onto a transfer material 7, which is taken out and supplied between the photosensitive member 1 and the transfer means 6 from a paper feed unit (not shown) synchronously with the rotation of the photosensitive member 1.

The transfer material 7 to which the image is transferred is separated from the surface or the photosensitive member 1, and introduced into image fixing means 8 in which the image is fixed to print out a copy to the outside of the apparatus. After image transfer, the toner remaining on the surface of the photosensitive member 1 is removed by cleaning means 9 to produce the clean surface. Furthermore, the photosensitive member 1 is destaticized by pre-exposure light 10 from pre-exposure means (not shown), and then repeatedly used for forming images. As shown in FIG. 1, where the primary charging means 3 is contact charging means comprising a charging roller, pre-exposure need not be provided.

In the present invention, of the components such as the electrophotographic photosensitive member 1, the primary charging means 3, the development means 5, and the cleaning means 9, a plurality of components may be integrally combined to form a process cartridge, which can be detached from the body of the electrophotographic apparatus such as a copying machine, a laser beam printer, or the like. For example, at least one of the primary charging means 3, the development means 5, and the cleaning means 9 is integrally supported together with the photosensitive member 1 to form a cartridge 11 which can be detached from the body of the apparatus by using guide means such as rails 12 of the apparatus.

In an electrophotographic apparatus such as a copying machine or a printer, the exposure light 4 is light reflected from or transmitted through an original, or light applied by reading the original using a sensor to generate a signal, and scanning a laser beam or driving a LED array and a liquid crystal shutter array according to the signal.

The electrophotographic photosensitive member of the present invention can be used not only for the electrophotographic apparatus but also for the electrophotography applied field of a laser printer, a CET printer, a LED printer, a liquid crystal printer, laser plate making, etc.

The present invention is described below with reference to examples. In the examples, "parts" means "parts by mass".

The diorganopolysiloxane used in the present invention can be synthesized as described in the following synthesis examples.

SYNTHESIS EXAMPLE 1

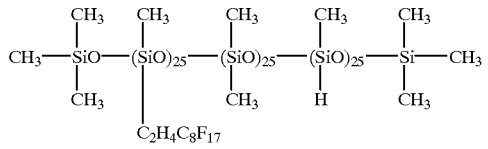

3.23 g of polysiloxane represented by the above formula, 20 ppm (5% isopropyl alcohol solution) of chloroplatinic acid, 18.9 of allyl-functional polystyrene represented by the following formula, and 80 g of m-xylene hexafluoride were mixed in a flask, and gradually heated.

$$CH_2{=}CHSi(CH_3)_2(C_2H_3C_6H_5)_{35}C_4H_9$$

The reaction was further continued at 80° C. for 6 hours. Then, pressure was reduced to 2.67 kPa (20 Torr) at 140° C. to remove the solvent and low-boiling-point components. As a result of analysis of the resultant reaction product by $^{29}$Si-NMR, $^{13}$C-NMR and FT-IR, the product was found to be diorganopolysiloxane (referred to as "$P_1$" hereinafter) represented by the following formula:

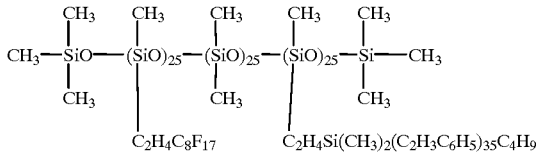

SYNTHESIS EXAMPLE 2

$$CH_2{=}CHCH_2(C_2H_3C_6H_5)_{25}C_4H_9$$

The same procedure as Synthesis Example 1 was repeated except that allyl-functional polystyrene represented by the above formula was used to obtain diorganopolysiloxane (referred to as "$P_2$" herinafter) represented by the following formula:

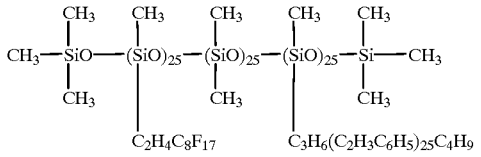

The examples will be described below. In the examples, "parts" represents "parts by mass".

EXAMPLE 1

A coating material comprising the materials below was coated on a support member comprising an aluminum cylinder having a diameter of 30 mm and a length of 357.5 mm by the dip coating method, and then hardened at 140° C. for 30 minutes to form a conductive layer having a thickness of 15 μm.

| | |
|---|---|
| Conductive pigment: $SnOi_2$-coated barium sulfate | 10 parts |
| Resistance control pigment: titanium oxide | 2 parts |
| Binder resin: phenol resin | 6 parts |
| Leveling agent: silicone oil | 0.001 parts |
| Solvent: methanol/methoxypropanol (mass ratio = 0.2/0.8) | 20 parts |

Next, a solution obtained by dissolving 3 parts of N-methoxymethylated nylon and 3 parts of copolymer nylon in a mixed solvent of 65 parts methanol/30 parts n-butanol was coated on the conductive layer by the dip coating method, and then dried to form an intermediate layer having a thickness of 0.5 μm.

Next, 4 parts of oxytitanium phthalocyanine having strong peaks at blank angles (2θ±0.2°) of 9.0°, 14.2°, 23.9° and 27.1° in CuKα characteristic X-ray diffraction, 2 parts of polyvinyl butyral (trade name; ESREX BM2, produced by Sekisui Chemical Co., Ltd.), and 60 parts of cyclohexanone were dispersed by a sand mill using glass beads having a diameter of 1 mm for 4 hours. Then, 100 parts of ethyl acetate was added to the resultant dispersion to prepare a disperse solution for a charge generation layer. The thus-prepared disperse solution was coated by the dip coating method, and dried to form a charge generation layer having a thickness of 0.3 μm.

In order to form a charge transport layer, a coating material for the charge transport layer was next prepared. First, 10 parts of resin (viscosity average molecular weight (abbreviated to "Mv" hereinafter): 45,000) having constitutional unit example 4-2 and used as a polyallylate resin was dissolved in 100 parts of chlorobenzene. Then, 10 parts of tetrafluoroethylene resin particles (trade name: LUBRON L-2, primary particle diameter: 0.3 μm, secondary particle diameter: 5 μm, produced by Daikin Industries, Ltd.) and 2 parts of diorganopolysiloxane ($P_1$) obtained in Synthesis Example 1 were added to the resultant solution, followed by sufficient mixing. The thus-obtained mixture was dispersed twice by using the liquid collision type dispersion machine to prepare fluororesin particle dispersed solution.

Next, the polyallylate resin, amine compounds A and B represented by the following formulae, and a solvent were added to the fluororesin particle dispersed solution so that the final ratios by mass of the polyallylate resin, amine compound A, amino compound B, tetrafluoroethylene, diorganopolysiloxane and the solvent were 10, 9, 1, 1, 0.2 and 8, respectively.

Amine Compound A Amine Compound B

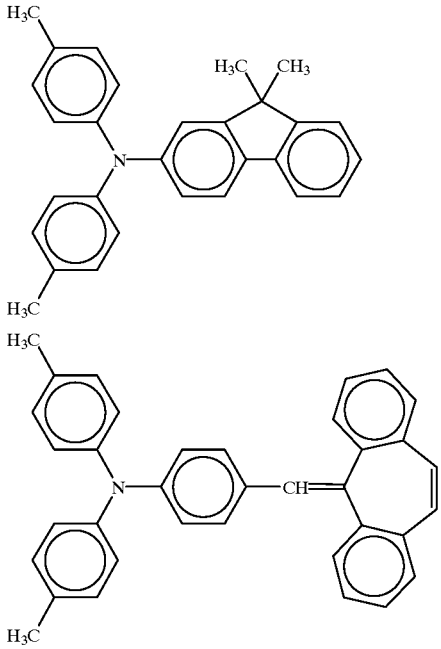

The solvent was prepared so that the final ratio by mass of monochlorobenzene to dicloromethane was 1:1. The resultant coating material was coated by the dip coating method, and then dried at 130° C. for 1 hour to form the charge transport layer having a thickness of 30 μm.

Evaluation of the invention will now be described. The machine (21 sheets per minute). A high-voltage power supply substrate was modified so that primary charge was output during rotation of the electrophotographic photosensitive member. A cleaning blade was also modified to increase the pressure of the portion of an ordinary product in contact with the electrophotographic photosensitive member by 30%. In a test, images were repeatedly formed until fogging occurred over the entire surface of an image in a mode in which copying was carried out in an environment of 23° C. and humidity of 50% RH, stopped, and then immediately started An image comprised of a A4-size character pattern with a print ratio f 5%.

Furthermore, the surface potential was measured in the initial stage and after the duration of 30,000 copies to examine a difference (ΔV1) in highlight potential. The difference ΔV1 is represented by the value of {(absolute value of highlight potential after duration of 30,000 copies)−(absolute value of initial highlight potential)}. The quantity of light was set so that the initial highlight potential was −200 V. Furthermore, the contact angle between the surface of the photosensitive member and pure water was measured in the initial stage and after this duration. The results are shown in Table 1.

EXAMPLES 2 to 6

Electrophotographic photosensitive members were produced by the same method as Example 1 except that a polyarylate resin (Mv=44,000) having constitutional unit example 4-1, copolymer polyarylate resin (MV=60,000) having constitutional unit examples 4-2 and 4-23 at a ratio of 7:3, a polycarbonate resin (Mv=42,000) having constitutional unit example 5-4, a polycarbonate resin (Mv=40,000) having constitutional unit example 5-3, and copolymer polycarbonate (Mv=43,000) having constitutional unit examples 5-3 and 5-16 at a ratio of 1:1 were respectively used as the binder resin of the charge transport layer, followed by evaluation. The results are shown in Table 1.

EXAMPLES 7 to 12

Electrophotographic photosensitive members were produced by the same methods as Examples 1 to 6 except that diorganopolysiloxane ($p_2$) obtained in Synthesis Example 2 was used as organopolysiloxane, and then evaluated. The results are shown in Table 1.

TABLE 1

| Example | Durability (number of sheets on each of which fogging occurred over the entire surface of an image) | ΔV1 (V) | Contact angle (degree) Initial | After duration |
|---|---|---|---|---|
| 1 | 62,000 | 0 | 97 | 95 |
| 2 | 61,000 | 0 | 98 | 96 |
| 3 | 75,000 | 0 | 99 | 97 |
| 4 | 50,000 | 0 | 97 | 94 |
| 5 | 50,000 | 0 | 97 | 94 |
| 6 | 56,000 | 0 | 96 | 95 |
| 7 | 63,000 | 0 | 98 | 92 |
| 8 | 60,000 | 0 | 98 | 95 |
| 9 | 73,000 | 0 | 98 | 97 |
| 10 | 54,000 | 0 | 96 | 91 |
| 11 | 52,000 | 0 | 98 | 96 |
| 12 | 61,000 | 0 | 97 | 97 |

EXAMPLE 13

The same procedure as Example 1 was repeated up to the formation of the charge generation layer, and then the charge transport layer was formed as follows.

10 parts of polycarbonate resin (Mv: 40,000) having constitutional unit example 5-3 and 8 parts of amine compound B were dissolved in a mixed solvent of 40 parts chlorobenzene/40 parts dichloromethane to form a coating material. The resultant coating material was coated by the dip coating method, and then dried at 130° C. for 1 hour to form the charge transport layer having a thickness of 20 μm.

Furthermore, a protecting layer was formed according to the following procedure.

First, 100 parts of antimony-containing tin oxide fine particles (produced by Mitsubishi Materials Corporation, trade name: T1) having an average particle diameter of 0.02 μm, 30 parts of (3,3,3-trifluoropropyl)trimethoxysilane (produced by Shin-Etsu Chemical Co., Ltd.) and 300 parts of 95ethanol aqueous solution were mixed to form a solution, and the resultant solution was dispersed by a milling apparatus for 1 hour, and then filtered. The residue was washed with ethanol, dried and then heated at 120° C. for 1 hour to treat the surfaces of the tin oxide fine particles.

Next, 25 parts of the acryl monomer below, 0.5 part of 2-methylthioxanthone, 35 parts of the surface-treated tin oxide particles, and 300 parts of toluene were mixed, and then dispersed by a sand mill for 96 hours to form a disperse solution. Then, 25 parts of tetrafluoroethylene resin particles (produced by Daikin Industries, Ltd., trade name: LUBRON L-2, primary diameter 0.3 μm, secondary diameter 5 μm) and 10 parts of diorganopolysiloxane ($P_2$) obtained in Synthesis Example 2 were mixed with the resultant disperse solution, and again dispersed by the sand mill for 8 hours. The thus-obtained fluororesin particle dispersed solution was coated by spray coating, dried, and then irradiated with ultraviolet rays by a high-pressure mercury lamp for 15 seconds with light intensity of 800 mW/cm$^2$ to form the protecting layer having a thickness of 4 μm.

The thus-obtained electrophotographic photosensitive member was evaluated by the same method as Example 1. The results are shown In Table 2.

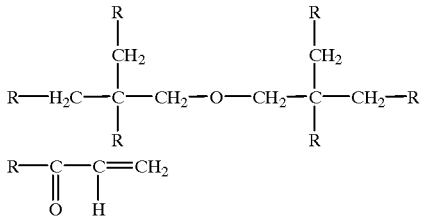

EXAMPLE 14

The same procedure as Example 11 was repeated up to the formation of the charge transport layer, and then the protecting layer was formed as follows.

First, 35 parts of polycarbonate resin (Mv=89,000) having constitutional unit example 5-3 was dissolved in 100 parts of chlorobenzene, and 5 parts of tetrafluoroethylene resin particles (produced by Daikin Industries, Ltd., trade name: LUBRON L-2, primary diameter 0.3 μm, secondary diameter 5 μm) and 2 parts of diorganopolysiloxane ($P_2$) obtained in Synthesis Example 2 were added to the resultant solution, and sufficiently shaken. The resultant mixture was dispersed twice by the liquid collision type dispersion machine to prepare a fluororesin particle dispersed solution.

Then, a polycarbonate resin having constitutional unit example 5-3, amine compound B and a solvent were added to the fluororesin particle dispersed solution so that the final ratios by mass of the polycarbonate resin, the amine compound B, tetrafluoroethylene, and the solvent were 2, 1, 1, and 100, respectively. The solvent was prepared so that the final ratio by mass of monochlorobenzene to dichloromethane was 1:0.4. Thus-obtained coating material was coated by spray coating, and then dried at 130° C. for 1 hour to form the protecting layer having a thickness of 6 μm.

The thus-obtained electrophotographic photosensitive member 1 was evaluated by the same method as Example 1. The results are shown in Table 2.

TABLE 2

| Example | Durability (number of sheets on each of which fogging occurred over the entire surface of an image) | ΔV1 (V) | Contact angle (degree) Initial | After duration |
|---|---|---|---|---|
| 13 | 70,000 | 0 | 97 | 88 |
| 14 | 83,000 | 0 | 107 | 105 |

The coating solutions for the surface layer prepared in Examples 1 to 12 were good disperse solutions causing neither agglomeration nor sedimentation of fluororesin particles even after allowed to stand for 1 hour.

Comparative Example 1

The same procedure as Example 1 was repeated except that polymethyl methacrylate (trade name: ALON GF300, produced by Toagosei Co., Ltd.) having grafted fluorine components was used in place of diorganopolysiloxane to form an electrophotographic photosensitive member, followed by evaluation. The results are shown in Table 3.

Comparative Example 2

The same procedure as Example 14 was repeated except that polymethyl methacrylate (trade name: ALON GF300, produced by Toagosei Co., Ltd.) having grafted fluorine components was used in place of diorganopolysiloxane to form an electrophotographic photosensitive member, followed by evaluation. The results are shown in Table 3.

Comparative Examples 3 and 4

The same procedures as Examples 1 and 4 were repeated except that tetrafluoroethylene resin particles and diorganopolysiloxane were not used, followed by evaluation. The results are shown in Table 3.

Reference Example 1

The same procedure as Example 1 was repeated except that the compound represented by the following formula was used as diorganopolysiloxane to form an electrophotographic photosensitive member, followed by evaluation. The results are shown in Table 3.

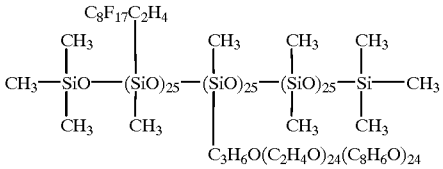

TABLE 3

| Comp. Example | Durability (number of sheets on each of which fogging occurred over the entire surface of an image) | ΔV1 (V) | Contact angle (degree) Initial | Contact angle (degree) After duration |
|---|---|---|---|---|
| 1 | 46,000 | 155 | 86 | 75 |
| 2 | 72,000 | 80 | 100 | 101 |
| 3 | 31,000 | 30 | 85 | 65 |
| 4 | 25,000 | 35(*) | 86 | 67 |
| Ref. Example 1 | 46,000 | 30 | 96 | 94 |

(*)The difference in highlight potential after duration of 25,000 copies.

As described above, the present invention can provide an electrophotographic photosensitive member having excellent durability and excellent surface lubricity, causing no failure in electrophotographic properties, and permitting the prevention of a variation in highlight potential in repeated use, and a process cartridge comprising the electrophotographic photosensitive member, and an electrophotographic apparatus.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An electrophotographic photosensitive member comprising a photosensitive layer formed on a conductive support member, wherein a surface layer of the electrophotographic photosensitive member contains diorganopolysiloxane represented by the following formula (1):

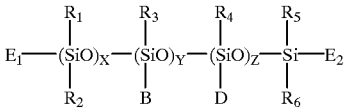

(1)

(wherein R1 to R6 each represent a substituted or unsubstituted hydrocarbon group, B represents a substituted or unsubstituted organic group having a perfluoroalkyl group, at least one D represents a substituted or unsubstituted polystyrene chain having a closed terminal and a degree of polymerization of 3 or more, $E_1$ and $E_2$ each represent a group selected from the group consisting of $R_1$ to $R_6$, B and D, X represents an integer of 0 to 1000, and Y and Z each represent an integer of 1 to 1000).

2. An electrophotographic photosensitive member according to claim 1, wherein the $R_1$ to $R_6$ each represent a methyl group or a phenyl group.

3. An electrophotographic photosensitive member according to claim 1, wherein the organic group having a perfluoroalkyl group is represented by the following formula (2):

$$—R_7—(CF_2)_a—F \quad (2)$$

(wherein $R_7$ represents an alkylene group or an alkyleneoxyalkylene group, and a represents an integer of 3 or more).

4. An electrophotographic photosensitive member according to claim 1, wherein the group having the polystyrene chain is represented by the following formula (3):

$$—W_1—(SiR_8R_9)_b—W_2 \quad (3)$$

(wherein $R_8$ and $R_9$ each represent a substituted or unsubstituted alkyl group, or a substituted or unsubstituted aryl group, $W_1$ represents a hydrocarbon group, $W_2$ represents a substituted or unsubstituted polystyrene chain having a closed terminal and a degree of polymerization of 3 or more, and b represents 0 or 1).

5. An electrophotographic photosensitive member according to claim 1, wherein the total (X+Y+Z) is 2 to 2000.

6. An electrophotographic photosensitive member according to claim 1, wherein the surface layer further contains fluororesin particles.

7. An electrophotographic photosensitive member according to claim 6, wherein the surface layer further contains a binder resin.

8. An electrophotographic photosensitive member according to claim 7, wherein the binder resin is a polyacrylate resin or a polycarbonate resin.

9. A process cartridge comprising an electrophotographic photosensitive member which is supported integrally with at least one means selected from the group consisting of charging means, development means, and cleaning means so that the cartridge is detachable from a body of an electrophotographic apparatus;

wherein the electrophotographic photosensitive member comprises a photosensitive layer formed on a conductive support member, and a surface layer of the electrophotographic photosensitive member contains diorganopolysiloxane represented by the following formula (1):

(1)

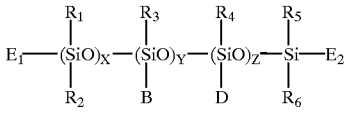

(wherein R1 to R6 each represent a substituted or unsubstituted hydrocarbon group, B represents a substituted or unsubstituted organic group having a perfluoroalkyl group, at least one D represents a substituted or unsubstituted polystyrene chain having a closed terminal and a degree of polymerization of 3 or more, E1 and E2 each represent a group selected from the group consisting of R1 to R6, B and D, X represents an integer of 0 to 1000, and Y and Z each represent an integer of 1 to 1000).

10. An electrophotographic apparatus comprising an electrophotographic photosensitive member, charging means, exposure means, development means, and transfer means;

wherein the electrophotographic photosensitive member comprises a photosensitive layer formed on a conductive support member, and a surface layer of the electrophotographic photosensitive member contains diorganopolysiloxane represented by the following formula (1):

(1)

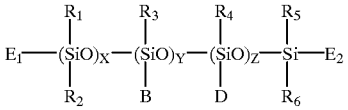

(wherein $R_1$ to $R_6$ each represent a substituted or unsubstituted hydrocarbon group, B represents a substituted or unsubstituted organic group having a perfluoroalkyl group, at least one D represents a substituted or unsubstituted polystyrene chain having a closed terminal and a degree of polymerization of 3 or more, $E_1$ and $E_2$ each represent a group selected from the group consisting of $R_1$ to $R_6$, B and D, X represents an integer of 0 to 1000, and Y and Z each represent an integer of 1 to 1000).

* * * * *

UNITED STATES PATENT AND TRADEMARK OFFICE

CERTIFICATE OF CORRECTION

PATENT NO. : 6,395,441 B1 
DATED : May 28, 2002
INVENTOR(S) : Hirotoshi Uesugi et al.

It is certified that error appears in the above-identified patent and that said Letters Patent is hereby corrected as shown below:

Column 1,
Line 27, "be" should read -- have --.

Column 2,
Line 56, "$R_7(CF_2)_2$-F ,(2)" should read -- $R_7$-$(CF_2)_a$-F ,(2) --.

Column 5,
Line 47, "1.000" should read -- 1,000 --.

Column 6,
Line 38, "Include" should read -- include --.

Column 18,
Line 45, "started" should read -- started. -- .and "comprised of" should read -- comprised --.

Column 19,
Line 51, "95 ethanol" should read -- 95% ethanol --.

Column 22,
Line 20, "R1 to R6" should read -- $R_1$ to $R_6$ --.

Column 23,
Line 14, "R1 to R2" should read -- $R_1$ to $R_6$ --.
Line 18, "E1 to E2" should read -- $E_1$ to $E_2$ --.
Line 19, "R1 to R6" should read -- $R_1$ to $R_6$ --.

Signed and Sealed this

Eighth Day of April, 2003

JAMES E. ROGAN
*Director of the United States Patent and Trademark Office*